US007455189B2

(12) United States Patent
Lane et al.

(10) Patent No.: US 7,455,189 B2
(45) Date of Patent: Nov. 25, 2008

(54) RECTANGULAR HOT-FILLED CONTAINER

(75) Inventors: Michael T. Lane, Brooklyn, MI (US); Dan Weissmann, Simsbury, CT (US); John Nievierowski, Ann Arbor, MI (US); Brad Caszatt, Manchester, MI (US)

(73) Assignee: Amcor Limited, Abbotsford, Victoria (AU)

( * ) Notice: Subject to any disclaimer, the term of this patent is extended or adjusted under 35 U.S.C. 154(b) by 175 days.

(21) Appl. No.: 11/208,896

(22) Filed: Aug. 22, 2005

(65) Prior Publication Data

US 2007/0039918 A1 Feb. 22, 2007

(51) Int. Cl.
*B65D 1/02* (2006.01)
*B65D 1/46* (2006.01)

(52) U.S. Cl. ..... 215/381; 215/384; 220/669; 220/671; 220/675

(58) Field of Classification Search ..... 215/379–384, 215/900; 220/669, 671, 672, 675, 666
See application file for complete search history.

(56) References Cited

U.S. PATENT DOCUMENTS

| | | | | |
|---|---|---|---|---|
| D320,154 | S | 9/1991 | Alberghini et al. | |
| 5,060,453 | A | 10/1991 | Alberghini et al. | |
| 5,064,081 | A | 11/1991 | Hayashi et al. | |
| 5,067,622 | A | 11/1991 | Garver et al. | |
| 5,199,588 | A | 4/1993 | Hayashi | |
| 5,222,615 | A | 6/1993 | Ota et al. | |
| 5,224,614 | A * | 7/1993 | Bono et al. | 215/384 |
| 5,238,129 | A | 8/1993 | Ota | |
| 5,381,910 | A | 1/1995 | Sugiura et al. | |
| 5,746,339 | A * | 5/1998 | Petre et al. | 215/383 |
| 5,908,127 | A | 6/1999 | Weick et al. | |
| D411,803 | S * | 7/1999 | Guertin | D9/520 |
| D421,721 | S * | 3/2000 | Guertin | D9/520 |
| 6,044,997 | A | 4/2000 | Ogg | |
| 6,161,713 | A | 12/2000 | Krich | |
| 6,257,433 | B1 | 7/2001 | Ogg et al. | |
| D451,032 | S | 11/2001 | Iizuka et al. | |
| D451,033 | S | 11/2001 | Iizuka et al. | |
| D452,444 | S | 12/2001 | Iizuka et al. | |
| D459,234 | S | 6/2002 | Bourque et al. | |
| 6,513,669 | B2 | 2/2003 | Ozawa et al. | |
| 6,575,321 | B2 | 6/2003 | Bourque et al. | |
| 6,662,960 | B2 | 12/2003 | Hong et al. | |
| 6,749,075 | B2 | 6/2004 | Bourque et al. | |
| 6,889,866 | B2 | 5/2005 | Gilliam et al. | |
| D507,746 | S * | 7/2005 | Sasaki et al. | D9/516 |
| 7,059,486 | B2 * | 6/2006 | Van Der Heijden et al. | 215/379 |
| D528,427 | S * | 9/2006 | Sasaki et al. | D9/541 |

(Continued)

FOREIGN PATENT DOCUMENTS

| | | | |
|---|---|---|---|
| WO | WO 2004037658 A1 * | 5/2004 | |
| WO | WO 2004/048060 | 6/2004 | |

*Primary Examiner*—Sue A Weaver
(74) *Attorney, Agent, or Firm*—Harness, Dickey & Pierce, P.L.C.

(57) ABSTRACT

A rectangular plastic container having a shoulder region adapted for vacuum pressure absorption, a sidewall portion having a rigid support ledge and a tapered base structure having an octagonal shaped footprint. The shoulder region including vacuum panels being moveable to accommodate vacuum related forces generated within the container. The shoulder region, sidewall portion and base each having differing horizontal cross sectional shapes.

20 Claims, 8 Drawing Sheets

U.S. PATENT DOCUMENTS

2004/0129669 A1 7/2004 Kelley et al.
2004/0164045 A1 8/2004 Kelley
2004/0195199 A1* 10/2004 Maki et al. ..... 215/381
2004/0195200 A1 10/2004 Bourque et al.
2005/0045645 A1 3/2005 Tsutsui et al.
2005/0211662 A1* 9/2005 Eaton et al. ..... 215/384
2005/0252881 A1 11/2005 Zhang et al.
2006/0175284 A1* 8/2006 Noll et al. ..... 215/382

* cited by examiner

RECTANGULAR HOT-FILLED CONTAINER

TECHNICAL FIELD OF THE INVENTION

This invention generally relates to plastic containers for retaining a commodity, and in particular a liquid commodity. More specifically, this invention relates to a rectangular plastic container having a shoulder region that allows for significant absorption of vacuum pressures without unwanted deformation in other portions of the container, a sidewall portion having increased rigidity and a tapered base structure having an octagonal footprint.

BACKGROUND OF THE INVENTION

As a result of environmental and other concerns, plastic containers, more specifically polyester and even more specifically polyethylene terephthalate (PET) containers are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. Studies have indicated that the configureation and overall aesthetic appearance of a blow-molded plastic container can affect consumer purchasing decisions. For example, a dented, distorted or otherwise unaesthetically pleasing container may provide the reason for some consumers to purchase a different brand of product which is packaged in a more aesthetically pleasing fashion.

While a container in its as-designed configuration may provide an appealing appearance when it is initially removed from a blow-molding machine, many forces act subsequently on, and alter, the as-designed shape from the time it is blow-molded to the time it is placed on a store shelf. Plastic containers are particularly susceptible to distortion since they are continually being re-designed in an effort to reduce the amount of plastic required to make the container. While this strategy realizes a savings with respect to material costs, the reduction in the amount of plastic can decrease container rigidity and structural integrity.

Manufacturers currently supply PET containers for various liquid commodities, such as juice and isotonic beverages. Suppliers often fill these liquid products into the containers while the liquid product is at an elevated temperature, typically between 155° F.-205° F. (68° C.-96° C.) and usually at approximately 185° F. (85° C.). When packaged in this manner, the hot temperature of the liquid commodity sterilizes the container at the time of filling. The bottling industry refers to this process as hot filling, and the containers designed to withstand the process as hot-fill or heat-set containers.

The hot filling process is acceptable for commodities having a high acid content, but not generally acceptable for non-high acid content commodities. Nonetheless, manufacturers and fillers of non-high acid content commodities desire to supply their commodities in PET containers as well.

For non-high acid content commodities, pasteurization and retort are the preferred sterilization processes. Pasteurization and retort both present an enormous challenge for manufactures of PET containers in that heat-set containers cannot withstand the temperature and time demands required of pasteurization and retort.

Pasteurization and retort are both processes for cooking or sterilizing the contents of a container after filling. Both processes include the heating of the contents of the container to a specified temperature, usually above approximately 155° F. (approximately 70° C.), for a specified length of time (20-60 minutes). Retort differs from pasteurization in that retort uses higher temperatures to sterilize the container and cook its contents. Retort also applies elevated air pressure externally to the container to counteract pressure inside the container. The pressure applied externally to the container is necessary because a hot water bath is often used and the overpressure keeps the water, as well as the liquid in the contents of the container, in liquid form, above their respective boiling point temperatures.

PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching a PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25% -30%.

After being hot-filled, the heat-set containers are capped and allowed to reside at generally the filling temperature for approximately five (5) minutes at which point the container, along with the product, is then actively cooled prior to transferring to labeling, packaging, and shipping operations. The cooling reduces the volume of the liquid in the container. This product shrinkage phenomenon results in the creation of a vacuum within the container. Generally, vacuum pressures within the container range from 1-380 mm Hg less than atmospheric pressure (i.e., 759 mm Hg-380 mm Hg). If not controlled or otherwise accommodated, these vacuum pressures result in deformation of the container, which leads to either an aesthetically unacceptable container or one that is unstable. Hot-fillable plastic containers must provide sufficient flexure to compensate for the changes of pressure and temperature, while maintaining structural integrity and aesthetic appearance. Typically, the industry accommodates vacuum related pressures with sidewall structures or vacuum panels formed within the sidewall of the container. Such vacuum panels generally distort inwardly under vacuum pressures in a controlled manner to eliminate undesirable deformation.

While vacuum panels allow containers to withstand the rigors of a hot-fill procedure, the panels have limitations and drawbacks. First, vacuum panels formed within the sidewall of a container do not create a generally smooth glass-like appearance. Second, packagers often apply a wrap-around or sleeve label to the container over the vacuum panels. The appearance of these labels over the sidewall and vacuum panels is such that the label often becomes wrinkled and not smooth. Additionally, one grasping the container generally feels the vacuum panels beneath the label and often pushes the label into various panel crevasses and recesses.

These traditional containers were not easy for consumers to handle while carrying or dispensing product from the container. Further refinements have led to the use of pinch grip geometry in the sidewall of the containers to help control container distortion resulting from vacuum pressures. However, similar limitations and drawbacks exist with pinch grip geometry as with vacuum panels.

In many instances, container weight is correlated to the amount of the final vacuum present in the container after this fill, cap and cool down procedure, that is, the container is made relatively heavy to accommodate vacuum related forces. Similarly, reducing container weight, i.e., "lightweight" the container, while providing a significant cost savings from a material standpoint, requires a reduction in the amount of the final vacuum.

External forces are applied to sealed containers as they are packed and shipped. Filled containers are packed in bulk in cardboard boxes, or plastic wrap, or both. A bottom row of packed, filled containers may support several upper tiers of filled containers, and potentially, several upper boxes of filled containers. Therefore, it is important that the container have a top loading capability which is sufficient to prevent distortion from the intended container shape.

More recently, container manufacturers have begun introducing multi-serve heat-set containers having a generally rectangular horizontal cross-sectional shape. Similar to the prior containers discussed above, these rectangular containers require a majority of the vacuum forces to be absorbed within the sidewall of the container. However, as these somewhat larger containers become increasingly lighter in weight, the weight of the fluid within the container reduces the amount of vacuum forces that the sidewall portion of the container can accommodate. Thus, this combination of lighter weight containers and increased weight of product within the container causes the sidewall portion of the container to sag and results in unwanted deformation in other areas of the container as well.

In an attempt to accommodate for some of the vacuum forces currently not accounted for in the sidewall, the grip area of current rectangular containers is designed to be flexible. This flexibility is detrimental to the consumer during handling, carrying and dispensing of product from the container. This flexibility may cause the container to slip from the consumer's hand or result in an overall insecure feel. Both of which may negatively effect consumer purchasing decisions.

Thus, there is a need for an improved lightweight rectangular container which can accommodate the vacuum pressures which result from hot filling, preventing container sidewall sag, while providing a more secure grip area which instills confidence in the consumer during handling, carrying and dispensing of product from the container.

SUMMARY OF THE INVENTION

Accordingly, this invention provides for a rectangular plastic container which maintains aesthetic and mechanical integrity during any subsequent handling after being hot-filled and cooled to ambient having a shoulder region that allows for significant absorption of vacuum pressures without unwanted deformation in other portions of the container, a sidewall portion having increased rigidity and a tapered base structure having an octagonal footprint. In a glass container, the container does not move, its structure must restrain all pressures and forces. In a bag container, the container easily moves and conforms to the product. The present invention is somewhat of a highbred, providing areas that move and areas that do not move. Ultimately, after the shoulder region of the rectangular plastic container of the present invention moves or deforms, the remaining overall structure of the container restrains all anticipated additional pressures or forces without collapse.

The present invention includes a plastic container having an upper portion, a shoulder region, a sidewall portion, and a base. The upper portion includes an opening defining a mouth of the container. The shoulder region includes at least one vacuum panel. The vacuum panel being movable to accommodate vacuum forces generated within the container. The sidewall portion has increased rigidity and extends from the shoulder region to the base. The base is defined in part by tapered walls.

Additional benefits and advantages of the present invention will become apparent to those skilled in the art to which the present invention relates from the subsequent description of the preferred embodiments and the appended claims, taken in conjunction with the accompanying drawings.

DETAILED DESCRIPTION OF THE PREFERRED EMBODIMENTS

The following description of the preferred embodiments is merely exemplary in nature, and is in no way intended to limit the invention or its application or uses.

As discussed above, to accommodate vacuum related forces during cooling of the contents within a PET heat-set container, containers typically have a series of vacuum panels or pinch grips around their sidewall, and/or flexible grip areas. The vacuum panels, pinch grips and flexible grip areas all deform inwardly, to some extent, under the influence of vacuum related forces and prevent unwanted distortion elsewhere in the container. However, with vacuum panels and pinch grips, the container sidewall cannot be smooth or glass-like, an overlying label often becomes wrinkled and not smooth, and end users can feel the vacuum panels and pinch grips beneath the label when grasping and picking up the container. With flexible grip areas, the container may more easily slip from the consumer's hand and/or result in an overall insecure feel. Additionally, in somewhat larger lightweight containers, with the above features in place, the container sidewall does not possess the requisite structure to prevent sagging and general unwanted distortion.

In a PET heat-set container, a combination of controlled deformation and vacuum resistance is required. This invention provides for a plastic container which enables its shoulder region under typical hot-fill process conditions to deform and move easily while maintaining a rigid structure (i.e., against internal vacuum) in the remainder of the container. As an example, in a 64 fl. oz. (1891 cc) plastic container, the container typically should accommodate roughly 60 cc of volume displacement. In the present plastic container, the shoulder region accommodates a significant portion of this requirement (i.e., roughly 12 cc or 20%). Accordingly, the shoulder region accounts for all noticeable distortion. The improved rigid construction of the remaining portions of the plastic container are easily able to accommodate the rest of this volume displacement without readily noticeable distortion.

Figure 1:
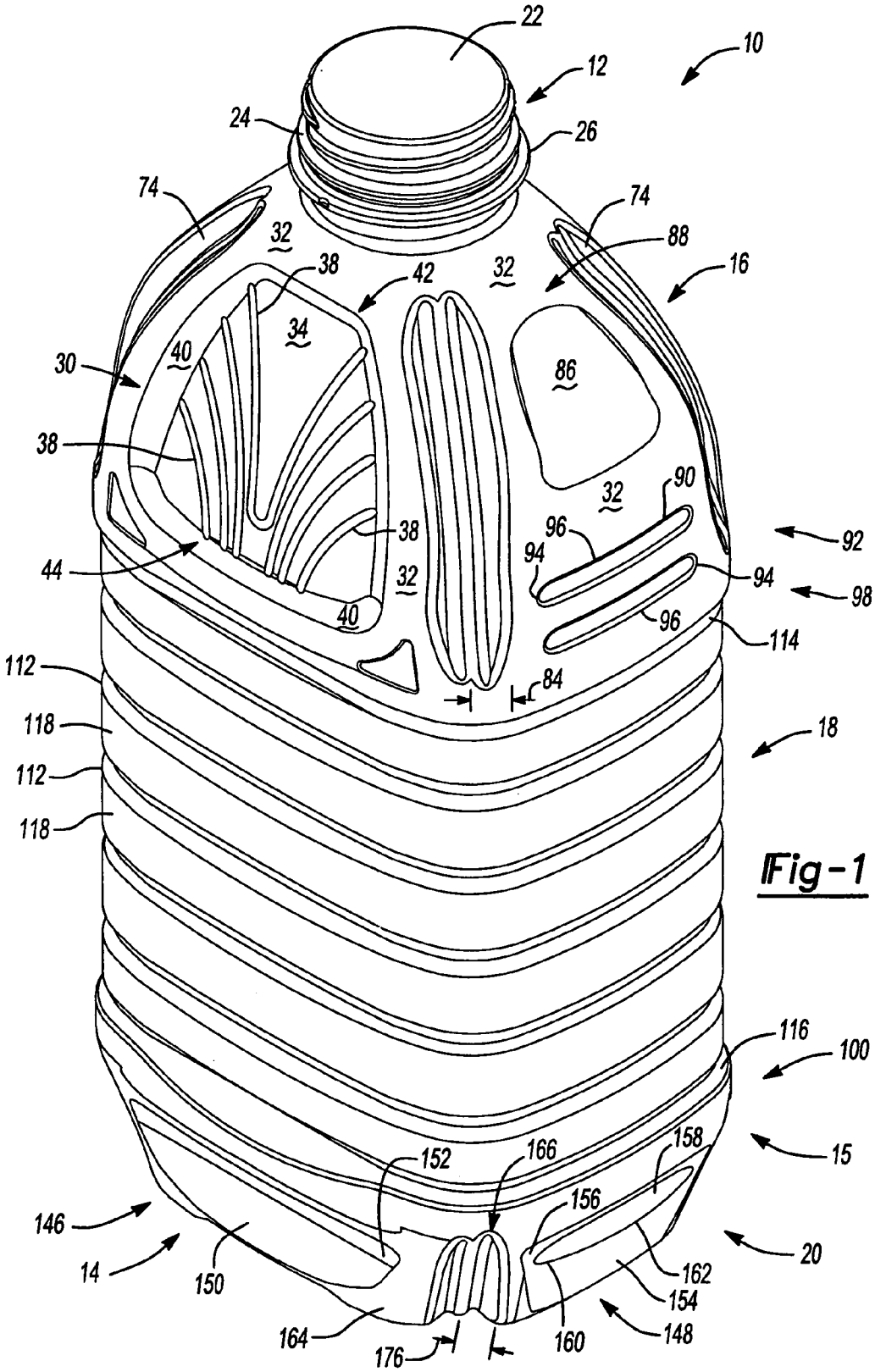
FIG. 1 is a perspective view of a plastic container constructed in accordance with the teachings of a preferred embodiment of the present invention, the container as molded and empty.
Figure 2:
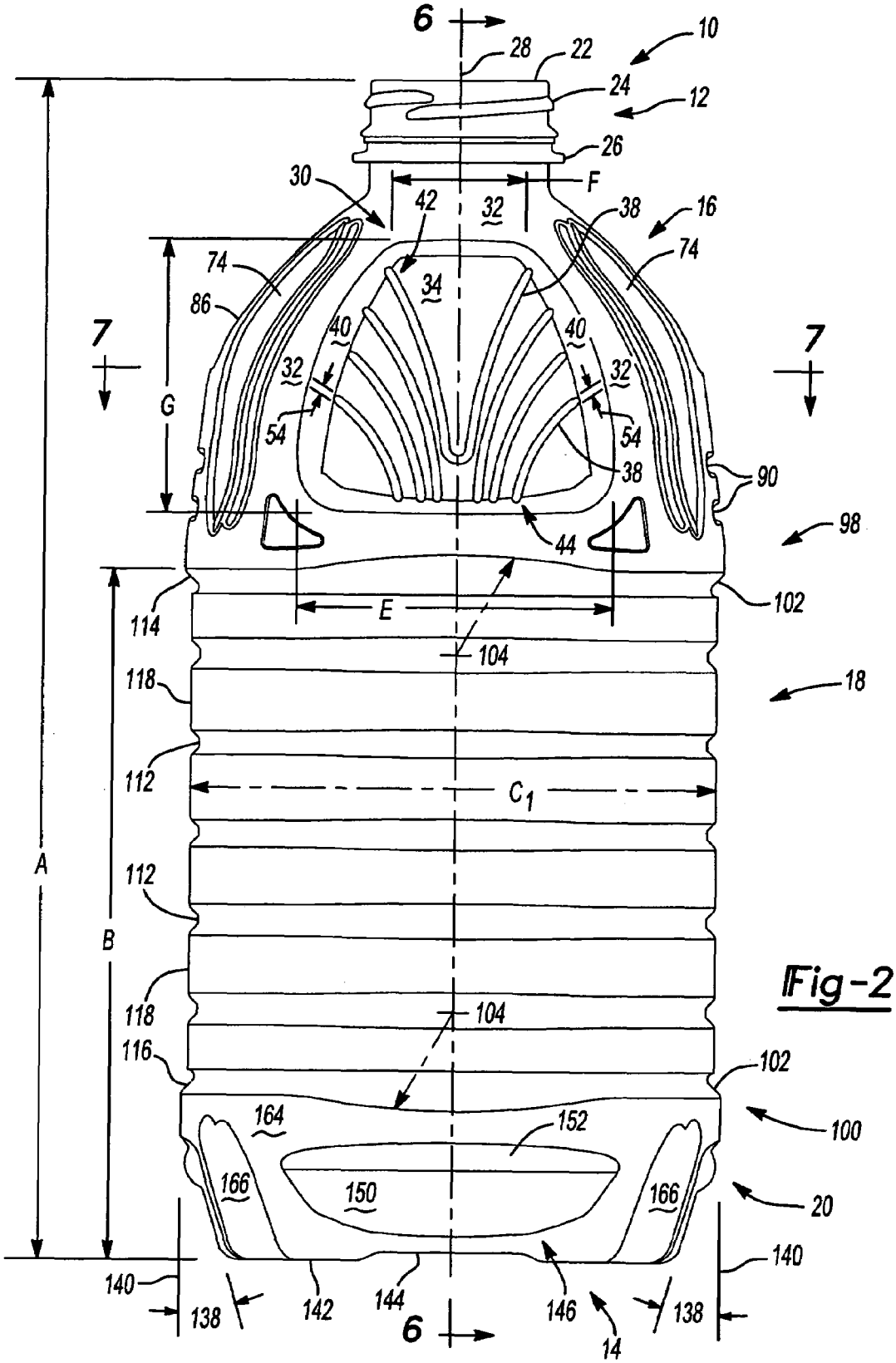
FIG. 2 is a front elevational view of the plastic container according to the present invention, the container as molded and empty, the rear view thereof being identical thereto.
Figure 3:
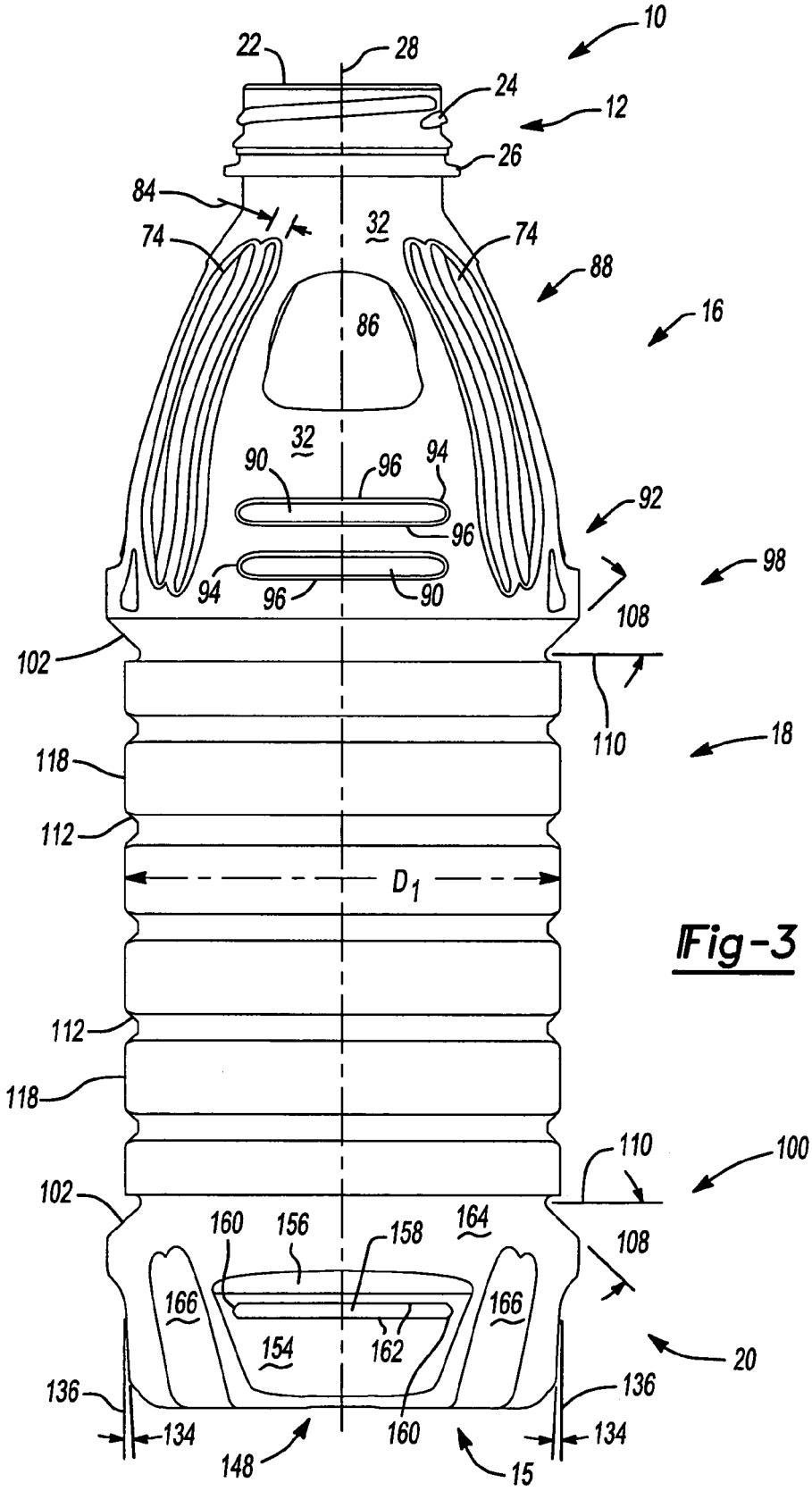
FIG. 3 is a right side view of the plastic container according to the present invention, the container as molded and empty, the left side view thereof being identical thereto.
Figure 4:
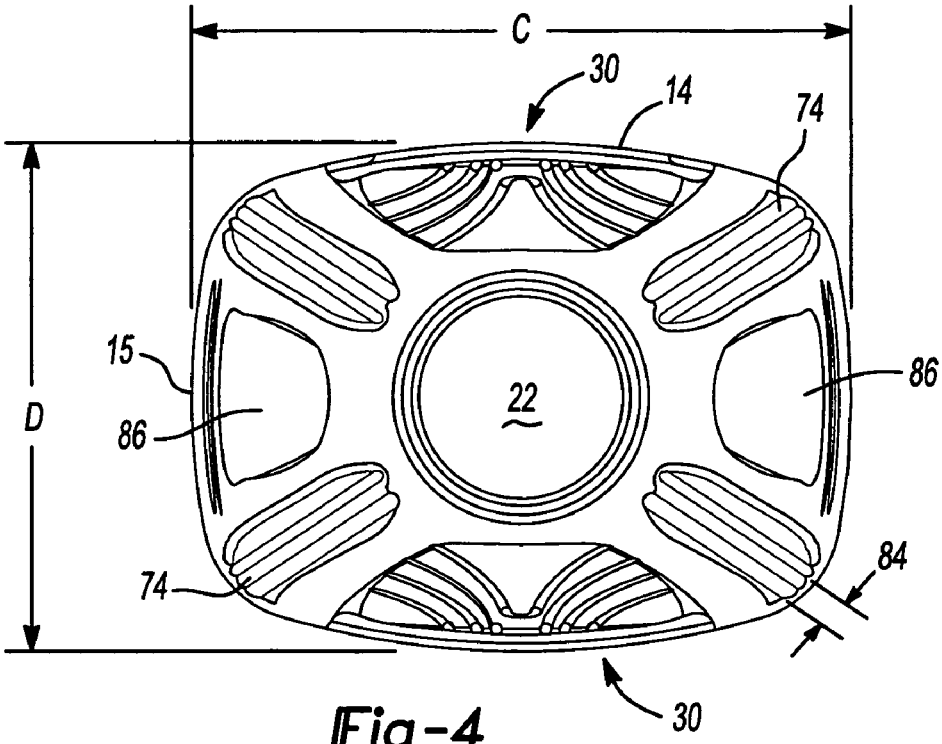
FIG. 4 is a top view of the plastic container of FIG. 1.
Figure 5:
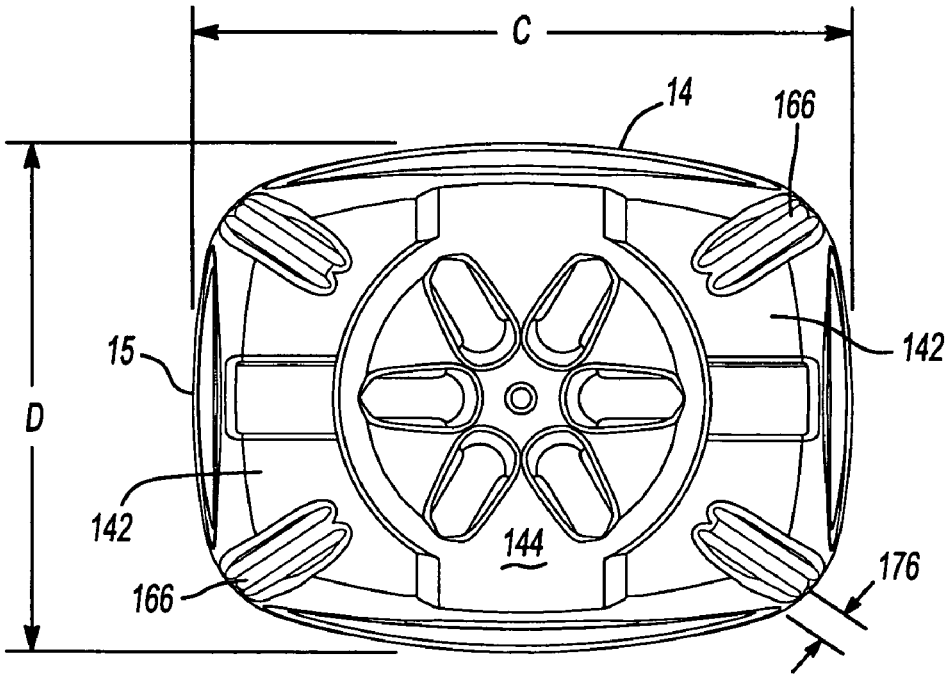
FIG. 5 is a bottom view of the plastic container of FIG. 1.

FIGS. 1-7 show one preferred embodiment of the present invention. In the figures, reference number 10 designates a plastic, e.g. polyethylene terephthalate (PET), hot-fillable container. As shown in FIG. 2, the container 10 has an overall height A of about 10.45 inch (266.19 mm), and a sidewall and base portion height B of about 5.94 inch (151.37 mm). The height A is selected so that the container 10 fits on the shelves of a supermarket or store. As shown in FIGS. 4 and 5, the container 10 is substantially rectangular in cross sectional shape including opposing longer sides 14 each having a width C of about 4.72 inch (120 mm), and opposing shorter, parting line sides 15 each having a width D of about 3.68 inch (93.52 mm). The widths C and/or D are selected so that the container 10 can fit within the door shelf of a refrigerator. Said differently, as with typical prior art bottles, opposing longer sides 14 of the container 10 of the present invention are oriented at approximately 90 degree angles to the shorter, parting line sides 15 of the container 10 so as to form a generally rectangular cross section as shown in FIGS. 4 and 5. In this particular embodiment, the container 10 has a volume capacity of about 64 fl. oz. (1891 cc). Those of ordinary skill in the art would appreciate that the following teachings of the present invention are applicable to other containers, such as round or square shaped containers, which may have different dimensions and volume capacities. It is also contemplated that other modifications can be made depending on the specific application and environmental requirements.

As shown in FIGS. 1-3, the plastic container 10 of the invention includes a finish 12, a shoulder region 16, a sidewall portion 18 and a base 20. Those skilled in the art know and understand that a neck (not illustrated) may also be included having an extremely short height, that is, becoming a short extension from the finish 12, or an elongated height, extending between the finish 12 and the shoulder region 16. The plastic container 10 has been designed to retain a commodity during a thermal process, typically a hot-fill process. For hot-fill bottling applications, bottlers generally fill the container 10 with a liquid or product at an elevated temperature between approximately 155° F. to 205° F. (approximately 68° C. to 96° C.) and seal the container 10 with a closure (not illustrated) before cooling. As the sealed container 10 cools, a slight vacuum, or negative pressure, forms inside causing the container 10, in particular, the shoulder region 16 to change shape. In addition, the plastic container 10 may be suitable for other high-temperature pasteurization or retort filling processes, or other thermal processes as well.

The plastic container 10 of the present invention is a blow molded, biaxially oriented container with an unitary construction from a single or multi-layer material. A well-known stretch-molding, heat-setting process for making the hot-fillable plastic container 10 generally involves the manufacture of a preform (not illustrated) of a polyester material, such as polyethylene terephthalate (PET), having a shape well known to those skilled in the art similar to a test-tube with a generally cylindrical cross section and a length typically approximately fifty percent (50%) that of the container height. A machine (not illustrated) places the preform heated to a temperature between approximately 190° F. to 250° F. (approximately 88° C. to 121° C.) into a mold cavity (not illustrated) having a shape similar to the plastic container 10. The mold cavity is heated to a temperature between approximately 250° F. to 350° F. (approximately 121° C. to 177° C.). A stretch rod apparatus (not illustrated) stretches or extends the heated preform within the mold cavity to a length approximately that of the container thereby molecularly orienting the polyester material in an axial direction generally corresponding with a central longitudinal axis 28 of the container 10. While the stretch rod extends the preform, air having a pressure between 300 PSI to 600 PSI (2.07 MPa to 4.14 MPa) assists in extending the preform in the axial direction and in expanding the preform in a circumferential or hoop direction thereby substantially conforming the polyester material to the shape of the mold cavity and further molecularly orienting the polyester material in a direction generally perpendicular to the axial direction, thus establishing the biaxial molecular orientation of the polyester material in most of the container. Typically, material within the finish 12 and a sub-portion of the base 20 are not substantially molecularly oriented. The pressurized air holds the mostly biaxial molecularly oriented polyester material against the mold cavity for a period of approximately two (2) to five (5) seconds before removal of the container from the mold cavity.

Alternatively, other manufacturing methods using other conventional materials including, for example, polyethylene naphthalate (PEN), a PET/PEN blend or copolymer, and various multilayer structures may be suitable for the manufacture of plastic container 10. Those having ordinary skill in the art will readily know and understand plastic container manufacturing method alternatives.

The finish 12 of the plastic container 10 includes a portion defining an aperture or mouth 22, a threaded region 24, and a support ring 26. The aperture 22 allows the plastic container 10 to receive a commodity while the threaded region 24 provides a means for attachment of a similarly threaded closure or cap (not illustrated). Alternatives may include other suitable devices that engage the finish 12 of the plastic container 10. Accordingly, the closure or cap (not illustrated) engages the finish 12 to preferably provide a hermetical seal of the plastic container 10. The closure or cap (not illustrated) is preferably of a plastic or metal material conventional to the closure industry and suitable for subsequent thermal processing, including high temperature pasteurization and retort. The support ring 26 may be used to carry or orient the preform (the precursor to the plastic container 10) (not illustrated) through and at various stages of manufacture. For example, the preform may be carried by the support ring 26, the support ring 26 may be used to aid in positioning the preform in the mold, or an end consumer may use the support ring 26 to carry the plastic container 10 once manufactured.

Integrally formed with the finish 12 and extending downward therefrom is the shoulder region 16. The shoulder region 16 merges into and provides a transition between the finish 12 and the sidewall portion 18. The sidewall portion 18 extends downward from the shoulder region 16 to the base 20. The specific construction of the shoulder region 16 of the container 10 allows the sidewall portion 18 of the heat-set container 10 to not necessarily require additional vacuum panels or pinch grips and therefore, the sidewall portion 18 is capable of providing increased rigidity and structural support to the container 10. The specific construction of the shoulder region 16 allows for manufacture of a significantly lightweight container. Such a container 10 can exhibit at least a 10% reduction in weight from those of current stock containers. The base 20 functions to close off the bottom portion of the plastic container 10 and, together with the finish 12, the shoulder region 16, and the sidewall portion 18, to retain the commodity.

The plastic container 10 is preferably heat-set according to the above-mentioned process or other conventional heat-set processes. To accommodate vacuum forces while allowing for the omission of vacuum panels and pinch grips in the sidewall portion 18 of the container 10, the shoulder region 16 of the present invention adopts a novel and innovative construction. Generally, the shoulder region 16 of the present invention includes vacuum panels 30 formed therein. As illustrated in the figures, vacuum panels 30 are generally polygonal in shape and are formed in the opposing longer sides 14 of the container 10. Accordingly, the container 10 illustrated in the figures has two (2) vacuum panels 30. The inventors however equally contemplate that more than two (2) vacuum panels 30, such as four (4), be required. That is, that vacuum panels 30 also be formed in opposing shorter, parting line sides 15 of the container 10 as well. Surrounding vacuum panels 30 is land 32. Land 32 provides structural support and rigidity to the shoulder portion 16 of the container 10.

As illustrated in the figures, vacuum panels 30 of the container 10 include an underlying surface 34, a wall thickness 36, a series of ribs 38 and a perimeter wall or edge 40. Ribs 38 have an upper portion 42, a lower portion 44, and a lower most point 46. In the preferred embodiment, ribs 38 are generally arcuately shaped, arranged horizontally, and generally spaced equidistantly apart from one another. That is, the lower portion 44 of adjacent ribs 38 is closer to one another, while the upper portion 42 of adjacent ribs 38 is further apart from one another. This geometrical arrangement of ribs 38 directs vacuum forces to the strongest portion of vacuum panels 30. While the above-described geometry of ribs 38 is the preferred embodiment, a person of ordinary skill in the art will readily understand that other geometrical designs and arrangements are feasible. Such alternative geometrical designs and arrangements may increase the amount of absorption vacuum panels 30 can accommodate. Accordingly, the exact shape of ribs 38 can vary greatly depending on various design criteria.

Ribs 38 also have an overall depth dimension 52 measured between the lower most point 46 and the underlying surface 34 of the vacuum panel 30 that is approximately equal to a width dimension 54 of ribs 38. Generally, the overall depth dimension 52 and the width dimension 54 for container 10 having a nominal capacity of approximately 64 fl. oz. (1891 cc) is between approximately 0.039 inch (1 mm) and approximately 0.157 inch (4 mm). Accordingly, the overall depth dimension 52 may vary slightly from one rib 38 to another rib 38.

The wall thickness 36 of vacuum panels 30 must be thin enough to allow vacuum panels 30 to be flexible and function properly. Accordingly, the material thickness at the lower most point 46 of ribs 38 is greater than the material thickness of the underlying surface 34. With this in mind, those skilled in the art of container manufacture realize that the wall thickness of the container 10 varies considerably depending where a technician takes a measurement within the container 10.

Vacuum panels 30 also include, and are surrounded by, a perimeter wall or edge 40. The perimeter wall or edge 40 defines the transition between the land 32 and the underlying surface 34 of vacuum panels 30, and is approximately 0.039 inch (1 mm) to approximately 0.236 inch (6 mm) in length. As is illustrated in the figures, the perimeter wall or edge 40 is shorter at the top and bottom portions of vacuum panels 30 and is longer at the right and left side portions of vacuum panels 30. Accordingly, the perimeter wall or edge 40 gradually declines toward the central longitudinal axis 28 of the container 10. One should note that the perimeter wall or edge 40 is a distinctly identifiable structure between the land 32 and the underlying surface 34 of vacuum panels 30. The perimeter wall or edge 40 provides strength to the transition between the land 32 and the underlying surface 34. The resulting localized strength increases the resistance to creasing and denting in the shoulder region 16.

Figure 6:
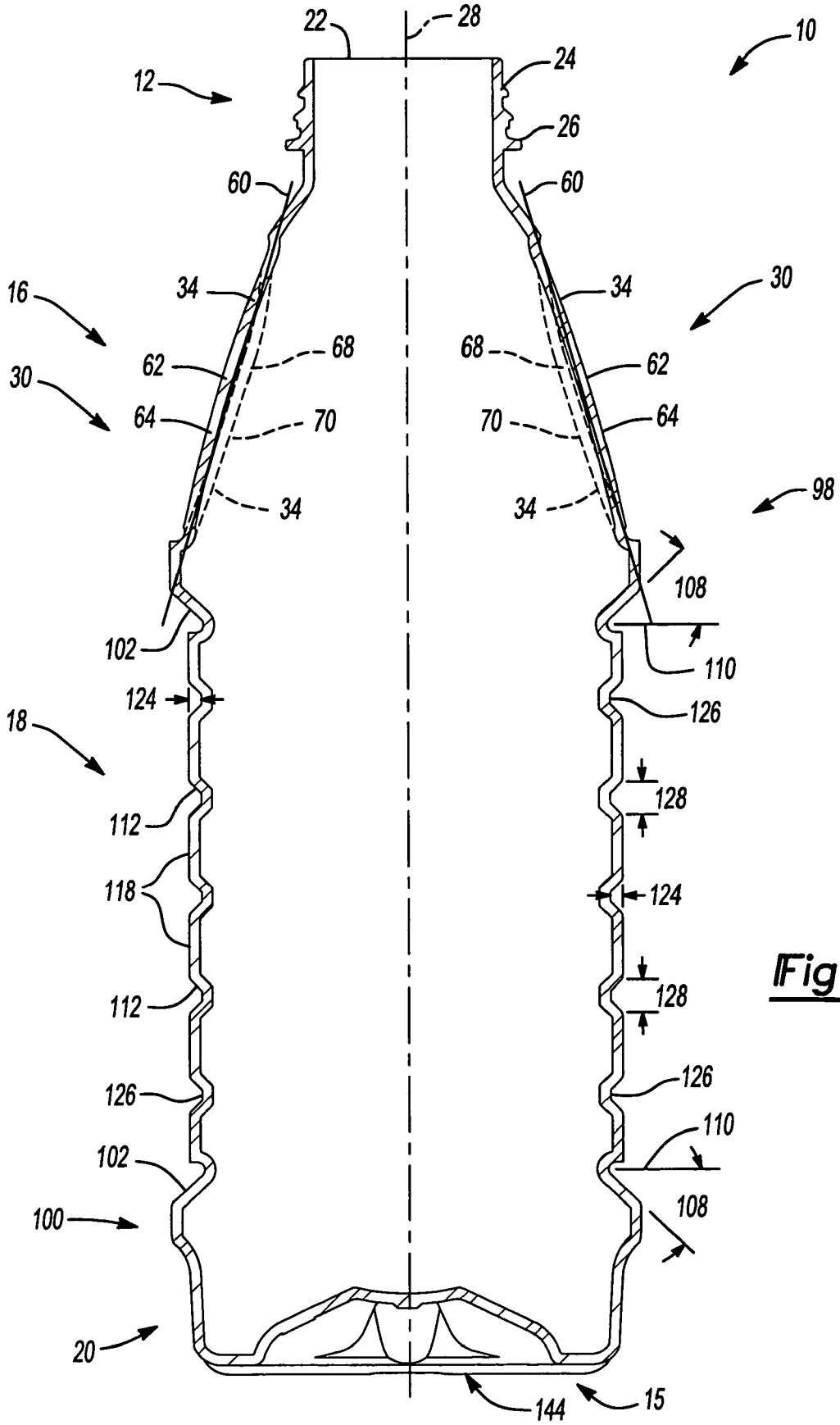
FIG. 6 is a cross-sectional view of the plastic container, taken generally along line 6-6 of FIG. 2.
Figure 7:
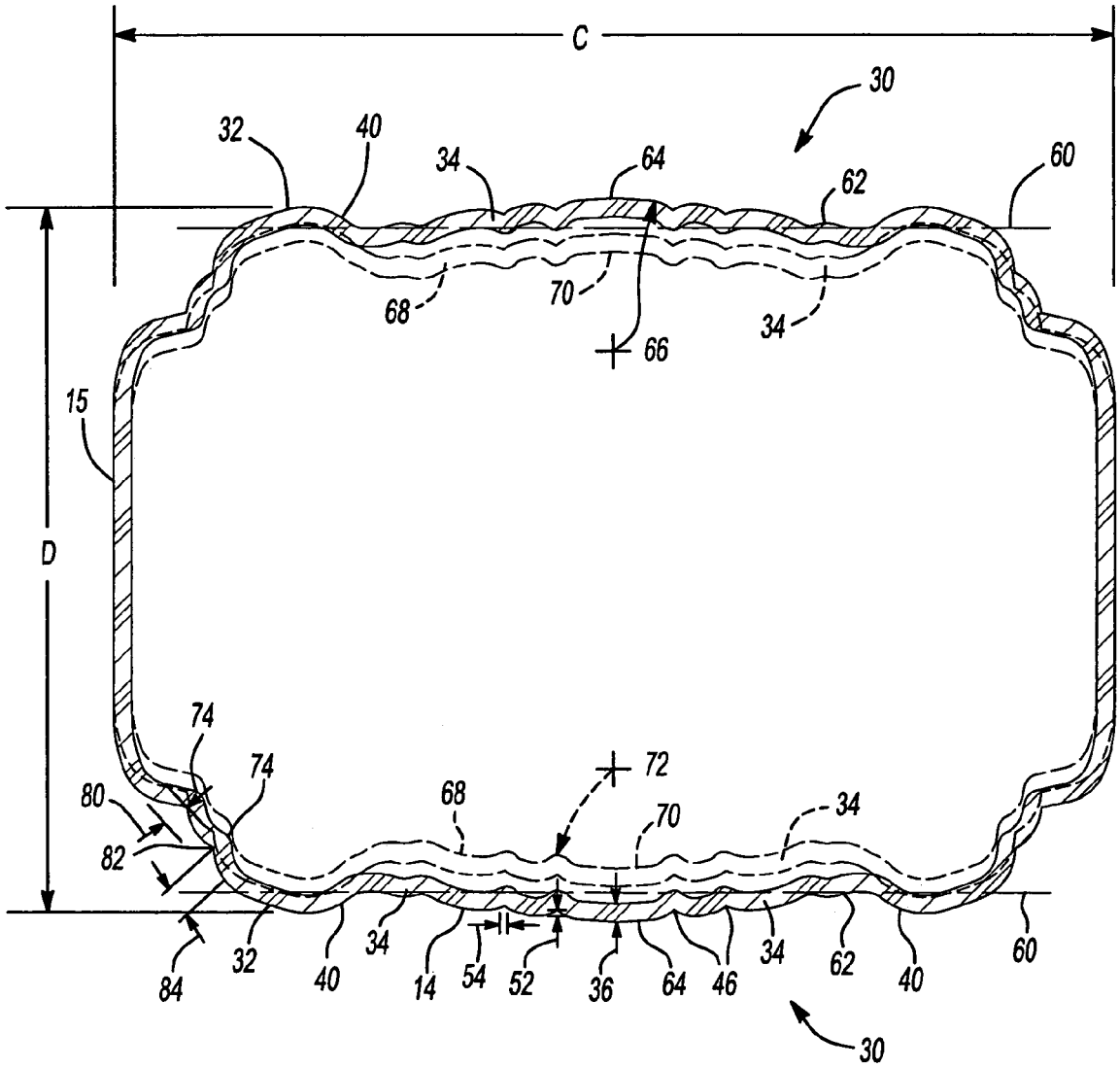
FIG. 7 is a cross-sectional view of the plastic container, taken generally along line 7-7 of FIG. 2.
Figure 8:
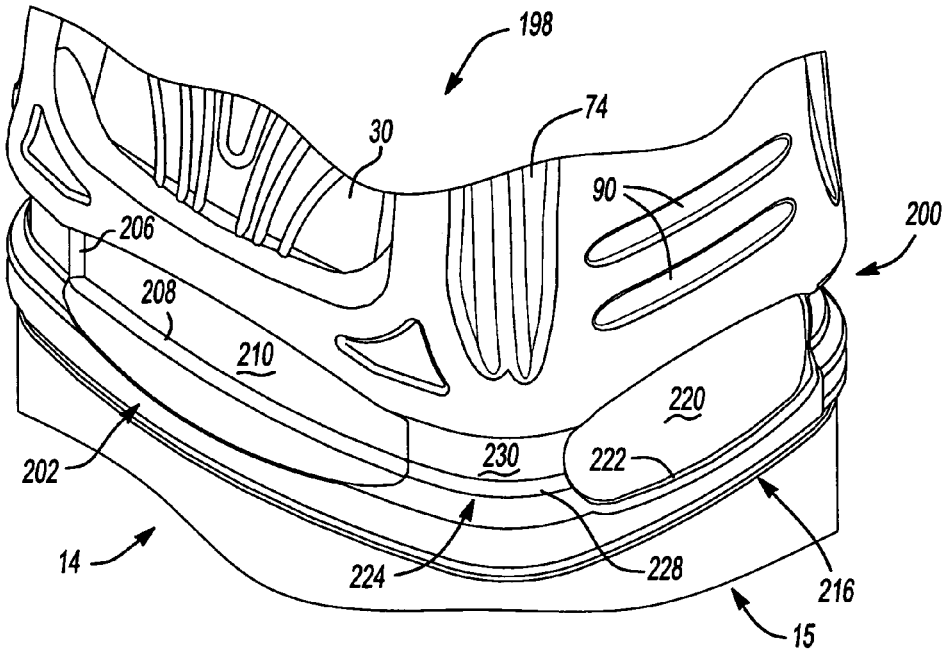
FIG. 8 is a perspective view of a partial plastic container alternative embodiment of the present invention having a grip area.
Figure 9:
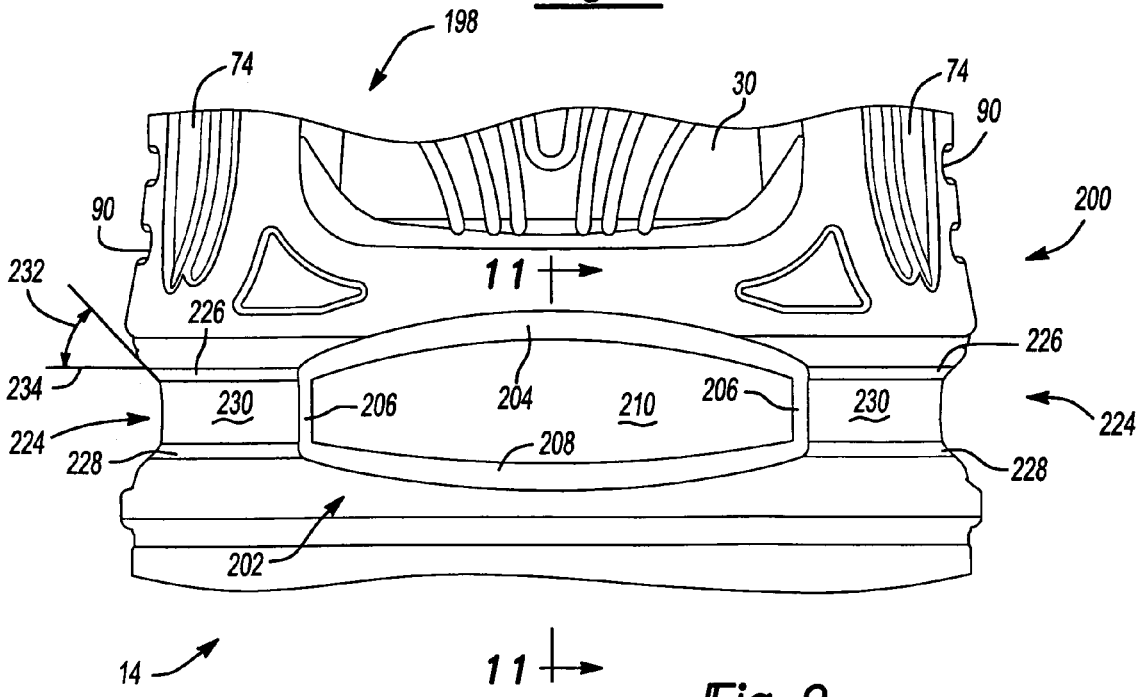
FIG. 9 is a front elevational view of the grip area of the plastic container of FIG. 8, the rear view thereof being identical thereto.
Figure 10:
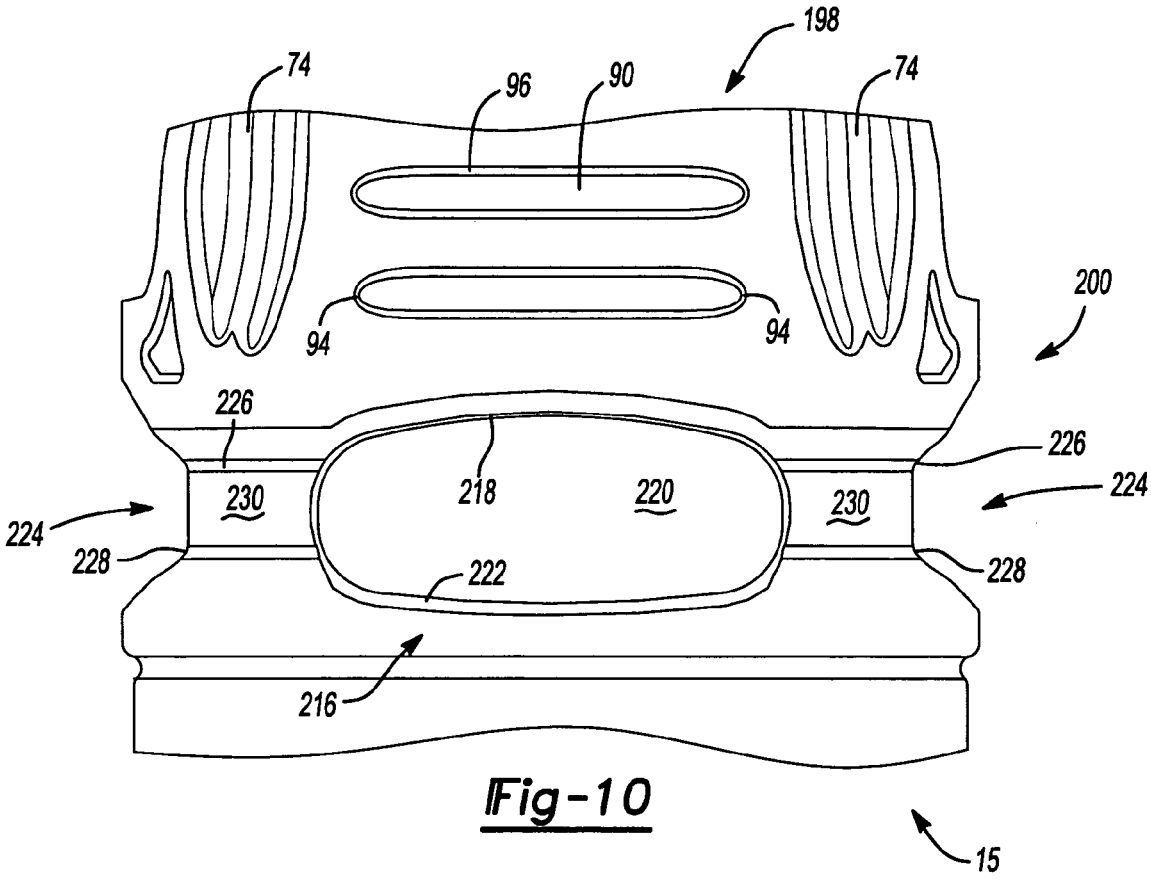
FIG. 10 is a right side view of the grip area of the plastic container of FIG. 8, the left side view thereof being identical thereto.
Figure 11:
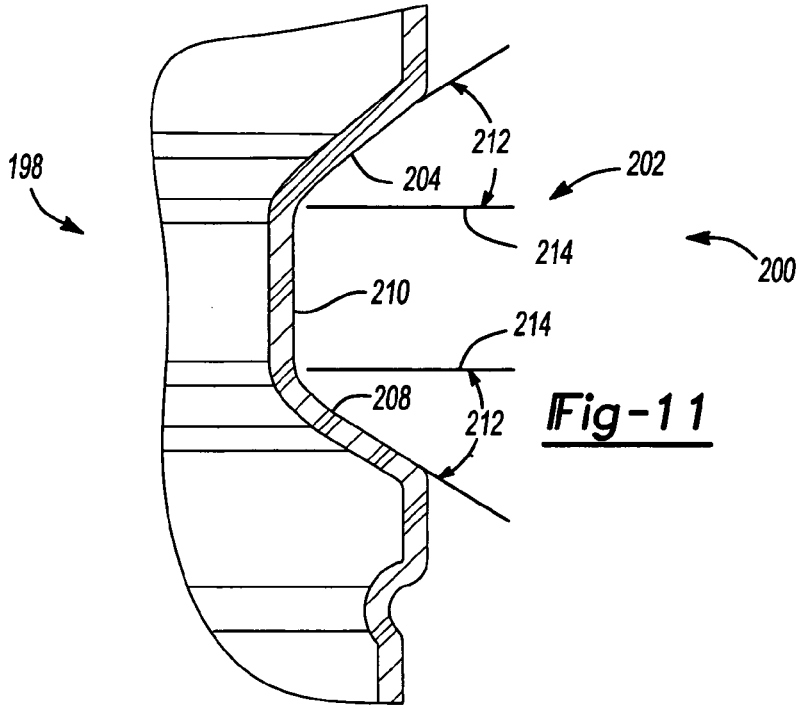
FIG. 11 is a cross-sectional view of the grip area of the plastic container of FIG. 8, taken generally along line 11-11 of FIG. 9.

As illustrated in FIG. 6, as molded, in cross section, the underlying surface 34 of vacuum panels 30 form a generally convex surface 62. An apex 64 of the convex surface 62 measures (for a typical container 10 having a nominal capacity of approximately 64 fl. oz. (1891 cc)) between approximately 0 inch (0 mm) and approximately 0.118 inch (3 mm) from a flat plane 60. As illustrated in the figures, flat plane 60 intersects a top portion and a bottom portion of the shoulder region 16 of the container 10. As illustrated in FIG. 7, as molded, in cross section, generally convex surface 62 of the underlying surface 34 has an underlying radius 66 suitable to establish a desired blending with the perimeter wall or edge 40.

Upon filling, capping, sealing and cooling, as illustrated in FIG. 6 in phantom, the perimeter wall or edge 40 acts as a hinge that aids in the allowance of the underlying surface 34 of vacuum panels 30 to be pulled radially inward, toward the central longitudinal axis 28 of the container 10, displacing volume, as a result of vacuum forces. In this position, the underlying surface 34 of vacuum panels 30, in cross section, illustrated in FIG. 6 in phantom, forms a generally concave surface 68. An apex 70 of the concave surface 68 measures (for a typical container 10 having a nominal capacity of approximately 64 fl. oz. (1891 cc)) between approximately 0 inch (0 mm) and approximately 0.118 inch (3 mm) from the flat plane 60. As illustrated in FIG. 7 in phantom, upon filling, capping, sealing and cooling, in cross section, generally concave surface 68 of the underlying surface 34 has an underlying radius 72 suitable to establish a desired blending with the perimeter wall or edge 40. The inventors anticipate that dimensions comparable to those set forth above are attainable for containers of varying sizes.

The greater the difference between the apex 64 and the apex 70, the greater the potential achievable displacement of volume. Said differently, the greater the inward radial movement between the apex 64 and the apex 70, the greater the achievable displacement of volume. The invention avoids deformation of the shoulder region 16, along with other portions of the container 10, by controlling and limiting the deformation to within vacuum panels 30. Accordingly, the thin, flexible geometry associated with vacuum panels 30 of the shoulder region 16 of the container 10 allows for greater volume displacement versus containers having a semi-rigid shoulder region.

The amount of volume which vacuum panels 30 of the shoulder region 16 displaces is also dependant on the projected surface area of vacuum panels 30 of the shoulder region 16 as compared to the projected total surface area of the shoulder region 16. In order to eliminate the necessity of providing vacuum panels or pinch grips in the sidewall portion 18 of the container 10, the projected surface area of vacuum panels 30 (two (2) vacuum panels) of the shoulder region 16 is required to be approximately 20%, and preferably greater than approximately 30%, of the total projected surface area of the shoulder region 16. The generally rectangular configuration of the container 10 creates a large surface area on opposing longer sides 14 of the shoulder region 16. The inventors have taken advantage of this large surface area by placing large vacuum panels 30 in this area. To maximize vacuum absorption, the contour of vacuum panels 30 substantially mimics the contour of the shoulder region 16. Accordingly, as illustrated in FIG. 2, this results in vacuum panels 30 having a bottom width E that is greater in length than a top width F. In the preferred embodiment, for the container 10 having a nominal capacity of approximately 64 fl. oz. (1891 cc), the width E is about 2.5 inch (63.5 mm) and the width F is about 1.25 inch (31.75 mm). In other words, the width E of vacuum panels 30 is approximately twice as long as the width F of vacuum panels 30. A height G of vacuum panels 30 is about 2.5 inch (63.5 mm), or said differently, is approximately 60% to approximately 80%, and more specifically approximately 70%, of a total height of the shoulder portion 16. Thus, the configuration of the shoulder region 16 promotes the use of large vacuum panels. Said another way, each individual vacuum panel 30 formed in opposing longer sides 14 of the shoulder region 16 may cover approximately 8% to approximately 12%, and more specifically approximately 10%, of the overall area of the shoulder region 16 of the container 10.

As illustrated in FIGS. 1-3 and 7, between opposing longer sides 14 and opposing shorter, parting line sides 15 of the container 10, in the corners of the shoulder region 16, are formed modulating vertical ribs 74. Modulating vertical ribs 74 substantially follow the contour of the shoulder region 16 and extend vertically continuously almost the entire distance of the shoulder region 16, between the finish 12 and the sidewall portion 18. Surrounding modulating vertical ribs 74 are land 32. Similar to ribs 38, modulating vertical ribs 74 have an overall depth dimension 80 measured between a lower most point 82 and the land 32. The overall depth dimension 80 is approximately equal to a width dimension 84 of modulating vertical ribs 74. Generally, the overall depth dimension 80 and the width dimension 84 for the container 10 having a nominal capacity of approximately 64 fl. oz. (1891 cc) is between approximately 0.039 inch (1 mm) and 0.157 inch (4 mm). As illustrated in the figures, modulating vertical ribs 74 are arranged between opposing longer sides 14 and opposing shorter, parting line sides 15 of the container 10, in the corners of the shoulder region 16, in pairs of two (2). While the above-described geometry of modulating vertical ribs 74 is the preferred embodiment, a person of ordinary skill in the art will readily understand that other geometrical designs and arrangements are feasible. Accordingly, the exact shape, number and orientation of modulating vertical ribs 74 can vary greatly depending on various design criteria.

In order to provide enhanced vacuum force absorption and accommodate top load forces, additional geometry is also included in opposing shorter, parting line sides 15 of the shoulder region 16 of the container 10. As illustrated in the figures, support panels 86 are formed in an upper portion 88 of opposing shorter, parting line sides 15 of the shoulder region 16. Support panels 86 are generally polygonal in shape and surrounded by land 32. Support panels 86 are centrally formed in the upper portion 88 of opposing shorter, parting line sides 15 of the shoulder region 16, and are parallel to the central longitudinal axis 28. The land 32 and support panels 86 provide additional structural support and rigidity to the shoulder region 16 of the container 10.

As illustrated in the figures, opposing shorter, parting line sides 15 of the shoulder region 16 also include a pair of ribs 90. Ribs 90 are centrally formed in a lower portion 92 of opposing shorter, parting line sides 15 of the shoulder region 16, below support panels 86. Ribs 90 are generally oval in shape having two half-circular end portions 94 separated by two horizontal portions 96. Ribs 90 are also surrounded by land 32. Similarly, the land 32 and ribs 90, in conjunction with support panels 86, provide additional structural support and rigidity to the shoulder region 16 of the container 10.

The unique construction of modulating vertical ribs 74, support panels 86 and ribs 90 add structure, support and strength to the shoulder region 16 of the container 10. This added structure and support, resulting from this unique construction, minimizes the outward movement or bowing, and denting of opposing shorter, parting line sides 15 of the shoulder region 16 of the container 10 during the fill, seal and cool down procedure. Thus, contrary to vacuum panels 30, modulating vertical ribs 74, support panels 86 and ribs 90 maintain their relative stiffness throughout the fill, seal and cool down procedure. The added structure and strength, resulting from the unique construction of modulating vertical ribs 74, support panels 86 and ribs 90, further aids in the transferring of top load forces thus aiding in preventing the shoulder region 16 of the container 10 from buckling, creasing, denting and deforming. Together, vacuum panels 30, modulating vertical ribs 74, support panels 86 and ribs 90 form a continuous integral rectangular shoulder region 16 of the container 10.

As illustrated in FIGS. 1-3, and briefly mentioned above, the sidewall portion 18 merges into and is unitarily connected to the shoulder region 16 and the base 20. Prior to this transition to the shoulder region 16 and the base 20, the sidewall portion 18 includes an upper ledge portion 98 and a lower ledge portion 100. The upper ledge portion 98 and the lower ledge portion 100 are mirror images of one another. The upper ledge portion 98 and the lower ledge portion 100 are defined, in part, by a peripheral ridge 102 formed in opposing longer sides 14 of the container 10. Peripheral ridge 102 has an underlying radius 104 suitable to establish a desired blending with sidewall portion 18.

The peripheral ridge 102 of the upper ledge portion 98 defines the transition between the shoulder region 16 and the sidewall portion 18, while the peripheral ridge 102 of the lower ledge portion 100 defines the transition between the base 20 and the sidewall portion 18. Accordingly, the peripheral ridge 102 of the upper ledge portion 98 and the peripheral ridge 102 of the lower ledge portion 100 are distinctly identifiable structures. The above-mentioned transitions must be abrupt in order to maximize the localized strength as well as form a geometrically rigid structure. The resulting localized strength increases the resistance to creasing, buckling, denting, bowing and sagging of the sidewall portion 18.

To accommodate top load forces on and provide enhanced stiffening strength capabilities to the sidewall portion 18 of the container 10, the upper ledge portion 98 and the lower ledge portion 100 are relatively deep and distinctive. To this end, the length of the peripheral ridge 102 of the upper ledge portion 98, and the peripheral ridge 102 of the lower ledge portion 100 are between approximately 0.079 inch (2 mm) and approximately 0.591 inch (15 mm), with an angle of divergence 108 from a horizontal plane 110 of approximately 35° to approximately 55°. The above and previously mentioned dimensions were taken from a typical sixty-four (64) fluid ounce hot fillable container. It is contemplated that comparable dimensions are attainable for containers of varying shapes and sizes.

Said differently, the upper ledge portion 98 and the lower ledge portion 100 extend radially outwardly from the sidewall portion 18 of the container 10 by about 0.039 inch (1 mm) to about 0.472 inch (12 mm), and more preferably by about 0.236 inch (6 mm) to about 0.394 inch (10 mm). Accordingly, a maximum width of the container 10 is defined at this point. As illustrated in FIGS. 4 and 5, and previously discussed above, the width C of opposing longer sides 14 of the upper ledge portion 98 and of the lower ledge portion 100 is about 4.72 inch (120 mm), and the width D of opposing shorter, parting line sides 15 of the upper ledge portion 98 and of the lower ledge portion 100 is about 3.68 inch (93.52 mm). While the width $C_1$ of opposing longer sides 14 of the sidewall portion 18 is about 4.61 inch (117 mm), and the width $D_1$ of opposing shorter, parting line sides 15 of the sidewall portion 18 is about 3.42 inch (86.87 mm). Accordingly, the width C is approximately less than 3%, and more specifically 2.5%, greater than the width $C_1$, while the width D is approximately more than 6%, and more specifically 7.1%, greater than the width $D_1$. Such divergence provides sufficient label protection and ease of manufacture while maintaining a nearly continuous transition from the shoulder region 16 to the sidewall portion 18, and from the sidewall portion 18 to the base 20. This nearly continuous transition enhances topload performance of the container 10. Opposing longer sides 14 of the sidewall portion 18 are inherently prone to deformation. The divergence between the width D and the width $D_1$ increases the radial strength of the sidewall portion 18 and aids in creating additional resistance to bowing, denting and buckling of the sidewall portion 18, while the peripheral ridge 102 of the upper ledge portion 98 and the lower ledge portion 100 further enhances the topload performance of the container 10.

The unique construction of the upper ledge portion 98 of the sidewall portion 18 not only provides increased rigidity to the sidewall portion 18, but also provides additional support to a consumer when the consumer grasps the container 10 in this area of the sidewall portion 18. The upper ledge portion 98 has a height, width and depth that are dimensioned and structured to provide support for a variety of hand sizes. The upper ledge portion 98 is adapted to support the fingers and thumb of a person of average size. However, the support feature of the upper ledge portion 98 is not limited for use by a person having average size hands. By selecting and structuring the height, width and depth of the upper ledge portion 98, user comfort is enhanced, good support is achieved and this support feature is capable of being utilized by persons having a wide range of hand sizes. Moreover, the dimensioning and positioning of the upper ledge portion 98, and thus the support feature, facilitates holding, carrying and pouring of contents from the container 10. Alternatively, to facilitate consumer handling, an area just beneath the upper ledge portion 98 may include a depression or indent.

Well known plastic containers in the art generally include a relatively tall shoulder region and a short base. As a result, such containers have label panels that are positioned somewhat lower on the container. In other words, the transition between the shoulder region and the sidewall portion in such traditional containers is near the center of gravity of the container. A point of weakness is often created along this transition between the shoulder region and the sidewall portion. This is problematic as it is undesirable to have a point of weakness near the center of gravity of the container. In the container 10, this negative feature is eliminated by incorporating a somewhat shorter shoulder region 16 and a somewhat taller base 20. This geometry effectively shifts the sidewall portion 18 of the container 10 upward, creating a substantially continuous, vertical surface along a central portion of the container 10 and thereby creating an inherently rigid structure. With this in mind, the height of the shoulder region 16 of the container 10 is generally about 32% to about 38%, and preferably about 35%, of the overall height of the container 10. The height of the sidewall portion 18 of the container 10 is generally about 42% to about 48%, and preferably about 45%, of the overall height of the container 10. The height of the base 20 of the container 10 is generally about 15% to about 21%, and preferably about 18%, of the overall height of the container 10. The combination of this geometric arrangement, effectively raising the sidewall portion 18, along with the upper ledge portion 98 and the lower ledge portion 100, provides a sidewall portion 18 of the container 10 with optimized strength and rigidity.

The sidewall portion 18 further includes a series of horizontal ribs 112. Horizontal ribs 112 are uninterrupted and circumscribe the entire perimeter of the sidewall portion 18 of the container 10. Horizontal ribs 112 extend continuously in a longitudinal direction from the shoulder region 16 to the base 20. In this regard, the underlying radius 104 of peripheral ridge 102 of upper ledge portion 98 blends with and merges into a first horizontal rib 114 in the series of horizontal ribs 112, while the underlying radius 104 of peripheral ridge 102 of lower ledge portion 100 blends with and merges into a last horizontal rib 116 in the series of horizontal ribs 112. Defined between each adjacent horizontal rib 112 are lands 118. Lands 118 provide additional structural support and rigidity to the sidewall portion 18 of the container 10.

Similar to ribs 38 and modulating vertical ribs 74, horizontal ribs 112 have an overall depth dimension 124 measured between a lower most point 126 and lands 118. The overall depth dimension 124 is approximately equal to a width dimension 128 of horizontal ribs 112. Generally, the overall depth dimension 124 and the width dimension 128 for the container 10 having a nominal capacity of approximately 64 fl. oz. (1891 cc) is between approximately 0.039 inch (1 mm) and approximately 0.157 inch (4 mm). As illustrated in the figures, in the preferred embodiment, the overall depth dimension 124 and the width dimension 128 are fairly consistent among all of the horizontal ribs 112. However, in alternate embodiments, it is contemplated that the overall depth dimension 124 and the width dimension 128 of horizontal ribs 112 will vary between opposing sides or all sides of the container 10, thus forming a series of modulating horizontal ribs. While the above-described geometry of horizontal ribs 112 is the preferred embodiment, a person of ordinary skill in the art will readily understand that other geometrical designs and arrangements are feasible. Accordingly, the exact shape, number and orientation of horizontal ribs 112 can vary depending on various design criteria.

As is commonly known and understood by container manufacturers skilled in the art, a label may be applied to the sidewall portion 18 using methods that are well known to those skilled in the art, including shrink wrap labeling and adhesive methods. As applied, the label may extend around the entire body or be limited to a single side of the sidewall portion 18.

The unique construction of the sidewall portion 18 provides added structure, support and strength to the sidewall portion 18 of the container 10. This added structure, support and strength enhances the top load strength capabilities of the container 10 by aiding in transferring top load forces, thereby preventing creasing, bulking, denting and deforming of the container 10 when subjected to top load forces. Furthermore, this added structure, support and strength, resulting from the unique construction of the sidewall portion 18, minimizes the outward movement, bowing and sagging of the sidewall portion 18 during fill, seal and cool down procedure. Thus, contrary to vacuum panels 30 formed in the shoulder region 16, the sidewall portion 18 maintains its relative stiffness throughout the fill, seal and cool down procedure. Accordingly, the distance from the central longitudinal axis 28 of the container 10 to the sidewall portion 18 is fairly consistent throughout the entire longitudinal length of the sidewall portion 18 from the shoulder region 16 to the base 20, and this distance is generally maintained throughout the fill, seal and cool down procedure. Additionally, the lower ledge portion 100 of the sidewall portion 18 isolates the base 20 from any possible sidewall portion 18 movement and creates structure, thus aiding the base 20 in maintaining its shape after the container 10 is filled, sealed and cooled, increasing stability of the container 10, and minimizing rocking as the container 10 shrinks after initial removal from its mold.

The base 20 of the container 10 is tapered, extending inward from the sidewall portion 18. To this end, opposing longer sides 14 of the base 20 have an angle of divergence 134 from a vertical plane 136 corresponding to the sidewall portion 18 of approximately 8° to approximately 12°, while opposing shorter, parting line sides 15 of the base 20 have an angle of divergence 138 from a vertical plane 140 corresponding to the sidewall portion 18 of approximately 15° to approximately 20°. Accordingly, opposing shorter, parting line sides 15 of the base 20 will generally have a greater degree of taper than opposing longer sides 14 of the base 20. This improves ease of manufacture and results in more consistent material distribution in the base. Thus improving container stability and eliminating the need for a traditional non-round base push-up, which must be oriented in the mold.

As illustrated in FIG. 5, the base 20 is generally octagonal in shape, creating a generally octagonal footprint. The base 20 generally includes a contact surface 142 and a circular push up 144. The contact surface 142 is itself that portion of the base 20 that contacts a support surface that in turn supports the container 10. As such, the contact surface 142 may be a flat surface or line of contact generally circumscribing, continuously or intermittently, the base 20. In the preferred embodiment, as illustrated in FIG. 5, the contact surface 142 is a uniform, generally octagonal shaped surface that provides a greater area of contact with the support surface, thus promoting greater container stability. The circular push up 144 is generally centrally located in the base 20. Because the circular push up 144 is centrally located in the base 20, there is no need to further orient the container 10 in the mold. Thus promoting ease of manufacture.

The base 20 further includes support panels 146 formed in opposing longer sides 14 of the base 20 and support panels 148 formed in opposing shorter, parting line sides 15 of the base 20. Support panels 146 include a vertical surface 150 and a downwardly angled surface 152. Support panels 148 include a vertical surface 154, a downwardly angled surface 156 and an outwardly extending rib 158. Outwardly extending rib 158 is formed in vertical surface 154 and is generally oval in shape having two half circular end portions 160 separated by two horizontal portions 162. Support panels 146 and 148 are surrounded by land 164.

In the corners of the base 20, between opposing longer sides 14 and opposing shorter, parting line sides 15, are formed modulating vertical ribs 166. Modulating vertical ribs 166 are collinear with modulating vertical ribs 74 and substantially follow the contour of the base 20, extending vertically continuously almost the entire distance of the base 20, between the sidewall portion 18 and the contact surface 142 of the base 20. Modulating vertical ribs 166 are surrounded by land 164. Similar to modulating vertical ribs 74, modulating vertical ribs 166 have an overall depth dimension measured between a lower most point and land 164. The overall depth dimension is approximately equal to a width dimension 176 of modulating vertical ribs 166. Generally, similar to modulating vertical ribs 74, the overall depth dimension and the width dimension 176 of modulating vertical ribs 166 for the container 10 having a nominal capacity of approximately 64 fl. oz. (1891 cc) is between approximately 0.039 inch (1 mm) and approximately 0.157 inch (4 mm). Accordingly, similar to modulating vertical ribs 74, modulating vertical ribs 166 are arranged in pairs of two (2).

Therefore, support panels 146, modulating vertical ribs 166, support panels 148 and land 164 form a continuous integral generally tapered, octagonal base 20 of the container 10. While the above-described geometry and features of the base 20 are the preferred embodiment, a person of ordinary skill in the art will readily understand that other geometrical designs and arrangements are feasible. Accordingly, the exact shape and orientation of features of the base 20 can vary greatly depending on various design criteria.

The unique construction of support panels 146, support panels 148 and modulating vertical ribs 166 of the base 20, and the unique geometry of the base 20 adds structure, support and strength to the container 10. This unique construction and geometry of the base 20 enables inherently thicker walls providing better rigidity, lightweighting, manufacturing ease and material consistency. This added structure and support, resulting from this unique construction and geometry minimizes the outward movement or bowing of the base 20 during the fill, seal and cool down procedure. Thus, the base 20 maintains its relative stiffness throughout the fill, seal and cool down procedure. The added structure and strength, resulting from the unique construction and geometry of the base 20, further aids in the transferring of top load forces thus aiding in the prevention of the base 20 buckling, creasing, denting and deforming.

FIGS. 8, 9, 10 and 11 illustrate an alternate embodiment of the container 10 according to the invention having a grip area.

Similar reference numerals will describe similar components between the two embodiments. As with the previous embodiment of the container 10, this embodiment, container 198, includes, but is not limited to, opposing longer sides 14, opposing shorter, parting line sides 15, the shoulder region 16, the sidewall portion 18 and the base 20. This embodiment, container 198, differs primarily from the previous embodiment, container 10, by including a grip area 200.

The grip area 200 merges into and is unitarily connected to the shoulder region 16 and the sidewall portion 18. The grip area 200 includes indents 202 formed in opposing longer sides 14 of the container 198. Indents 202 include a first arcuate ridge 204, vertical ridges 206, a second arcuate ridge 208 and a grip surface 210. The first arcuate ridge 204 and the second arcuate ridge 208 are mirror images of one another. Accordingly, the first arcuate ridge 204 and the second arcuate ridge 208 have a depth of between approximately 0.079 inch (2 mm) and approximately 0.472 inch (12 mm), and an angle of divergence 212 from a horizontal plane 214 of approximately 12° to approximately 18°. Similarly, vertical ridges 206 have a depth of between approximately 0.039 inch (1 mm) and approximately 0.118 inch (3 mm).

The grip area 200 further includes indents 216 formed in opposing shorter, parting line sides 15 of the container 198. Indents 216 are generally oval in shape and have a first arcuate ridge 218, an inwardly projecting radial surface 220 and a second arcuate ridge 222.

Defined between each adjacent indent 202 and indent 216 are lands 224. Lands 224 are formed in the corners of the container 198 and include an upper horizontal ridge 226, a lower horizontal ridge 228 and a grip surface 230. Upper horizontal ridge 226 and lower horizontal ridge 228 have a depth of between approximately 0.039 inch (1 mm) and approximately 0.197 inch (5 mm), and an angle of divergence 232 from a horizontal plane 234 of approximately 40° to approximately 50°.

By selecting and structuring the height, width and depth of the grip area 200, user comfort is further enhanced, a good hand-fit is achieved and this grip feature is capable of being utilized by persons having a wide range of hand sizes. Moreover, the dimensioning and positioning of the grip area 200 facilitates holding, carrying and pouring of contents from the container 198. Additionally, the grip area 200 provides continued structure, support and stiffening strength to the container 198.

As previously discussed, one of the significant benefits of the present invention is the reduction of vacuum pressure. The less vacuum pressure the container is subjected to, the greater the ability to lightweight the container. Containers 10 and 198 having vacuum panels 30 can displace the same amount of volume as a current stock control container at significantly less vacuum pressure thus allowing for containers 10 and 198 having vacuum panels 30 to be significantly lighter in weight. Accordingly, the novel shape and features of containers 10 and 198 further lends itself to a significant amount of lightweight. As compared to containers of similar volumetric sizes, shapes and types, containers 10 and 198, weighing as little as 66 grams, generally realizes at least a ten percent (10%) reduction in weight and as much as a fifteen percent (15%) reduction in weight.

While the above description constitutes the preferred embodiment and alternative embodiments of the present invention, it will be appreciated that the invention is susceptible to modification, variation and change without departing from the proper scope and fair meaning of the accompanying claims.

What is claimed is:

1. A plastic container comprising:

an upper portion having a mouth defining an opening into said container, a shoulder region extending from said upper portion, a sidewall portion extending from said shoulder region to a base, said base closing off an end of said container; said upper portion, said shoulder region, said sidewall portion and said base cooperating to define a receptacle chamber within the container into which product can be filled; said shoulder region defined in part by at least two vacuum panels formed therein, said vacuum panel being movable to accommodate vacuum forces generated within the container resulting from heating and cooling of its contents, wherein a projected surface area of said vacuum panels is at least approximately 20% of a total projected surface area of said shoulder region; said sidewall portion having a generally rectangular body including opposing longer sidewalls and opposing shorter sidewalls, defining a continuous container sidewall portion having a generally rectangular horizontal cross section and defined in part by a support ledge, said support ledge including a rigid support ledge formed in an upper portion of each of said opposing longer sidewalls of said sidewall portion, said rigid support ledge including a peripheral ridge having an underlying radius; and said base defined in part by tapered walls.

2. The container of claim 1 wherein said shoulder region comprises a generally rectangular horizontal cross section including two opposing longer sidewalls and two opposing shorter sidewalls.

3. The container of claim 2 wherein said shoulder region includes two generally polygonal shaped vacuum panels, one formed in each of said opposing longer sidewalls of said shoulder region and two support panels, one formed in each of said opposing shorter sidewalls of said shoulder region.

4. The container of claim 3 wherein each of said generally polygonal shaped vacuum panels includes a series of ribs formed therein.

5. The container of claim 3 wherein said shoulder region further includes a pair of modulating vertical ribs formed therein, said pair of modulating vertical ribs located between said generally polygonal shaped vacuum panels and said support panels.

6. The container of claim 5 wherein said base includes a generally octagonal shaped contact surface upon which the container is supported, a circular pushup located on a longitudinal axis of the container and a pair of modulating vertical ribs formed therein, said pair of modulating vertical ribs is collinear with said pair of modulating vertical ribs formed in said shoulder region.

7. The container of claim 1 wherein said sidewall portion further comprises a series of uninterrupted horizontal ribs, said horizontal ribs circumscribing a perimeter of said sidewall portion and extending in a longitudinal direction from said shoulder region to said base.

8. The container of claim 1 wherein a height of said shoulder region is generally about 32% to about 38% of an overall height of the container, a height of said sidewall portion is generally about 42% to about 48% of said overall height of the container, and a height of said base is generally about 15% to about 21% of said overall height of the container.

9. The container of claim 1 wherein said projected surface area of said vacuum panels is at least approximately 30% of said total projected surface area of said shoulder region.

10. The container of claim 1 wherein a contour of said vacuum panels substantially mimics a contour of said shoulder region.

11. The container of claim 1 wherein a height of said vacuum panels is approximately 60% to approximately 80% of a total height of said shoulder portion.

12. A plastic container filled with a liquid at an elevated temperature, sealed with a closure, and cooled thereby establishing a vacuum within said container, said container comprising:

an upper portion having a mouth defining an opening into the container and a finish for attaching the closure, a shoulder region extending from said upper portion, a sidewall portion extending from said shoulder region to a base, said base closing off an end of the container; said upper portion, said shoulder region, said sidewall portion and said base cooperating to define a receptacle chamber within the container into which the liquid can be filled at the elevated temperature between approximately 155° F. to 205° F. (approximately 68° C. to 96° C.); said shoulder region adapted for vacuum absorption, having a first shape in horizontal cross section, comprising a generally rectangular horizontal cross section having four sides, wherein opposing sides are equal in length, a first length of a first pair of opposing sides being greater than a second length of a second pair of opposing sides and defined in part by at least two generally polygonal shaped vacuum panels formed therein, one formed in each of said first pair of opposing sides, said vacuum panels being movable to accommodate vacuum forces generated within the container, wherein a projected surface area of said vacuum panels is at least approximately 20% of a total projected surface area of said shoulder region and two support panels, one formed in each of said second pair of opposing sides; said sidewall portion having a second shape in horizontal cross section, comprising a generally rectangular body including opposing longer sidewalls and opposing shorter sidewalls, defining a continuous container sidewall portion having a generally rectangular horizontal cross section and defined in part by a rigid support ledge, said rigid support ledge being formed in an upper portion of each of said opposing longer sidewalls of said sidewall portion, said rigid support ledge including a peripheral ridge having an underlying radius and extending radially outward from said sidewall portion between approximately 0.039 inch (1 mm) to approximately 0.472 inch (12 mm); and said base having a third shape in horizontal cross section and defined in part by tapered walls; wherein said first shape, said second shape and said third shape are each different from one another.

13. The container of claim 12 wherein said shoulder region further includes a pair of modulating vertical ribs formed therein, said pair of modulating vertical ribs located between said generally polygonal shaped vacuum panels and said support panels.

14. The container of claim 13 wherein said base includes a generally octagonal shaped contact surface upon which the container is supported, a circular pushup located on a longitudinal axis of the container and a pair of modulating vertical ribs formed therein, said pair of modulating vertical ribs is collinear with said pair of modulating vertical ribs formed in said shoulder region.

15. The container of claim 12 wherein a height of said shoulder region is generally about 32% to about 38% of an overall height of the container, a height of said sidewall portion is generally about 42% to about 48% of said overall height of the container, and a height of said base is generally about 15% to about 21% of said overall height of the container.

16. A label panel area of a plastic container adapted for vacuum absorption, the container having an upper portion including a mouth defining an opening into the container and a shoulder region, a lower portion forming a base, and the label panel area connected with and extending between said upper portion and said lower portion; the upper portion, the lower portion and the label panel area cooperating to define a receptacle chamber within the container into which product can be filled; said label panel area comprising sidewall portions that are generally parallel to a longitudinal axis of the container, said sidewall portions comprise a generally rectangular body including opposing longer sidewalls and opposing shorter sidewalls, defining a continuous container sidewall portion having a generally rectangular horizontal cross section; a rigid support ledge formed in said sidewall portions; and a series of horizontal ribs formed in said sidewall portions, wherein said rigid support ledge is defined in part by an angle of divergence from a horizontal plane perpendicular to said longitudinal axis of approximately 35° to approximately 55°, said rigid support ledge being formed in an upper portion of each of said opposing longer sidewalls of said sidewall portion, and including a peripheral ridge having an underlying radius and extending radially outward from said sidewall portion between approximately 0.039 inch (1 mm) to approximately 0.472 inch (12 mm).

17. The label panel area of claim 16 wherein a width of said rigid support ledge formed in said upper portion of each of said opposing longer sidewalls of said sidewall portion is approximately less than 3% greater than a width of said opposing longer sidewalls of said sidewall portion, and wherein a width of an upper portion of each opposing shorter sidewalls of said sidewall portion is approximately more than 6% greater than a width of said opposing shorter sidewalls of said sidewall portion.

18. The label panel area of claim 16 wherein said series of horizontal ribs are separated by lands, uninterruptedly circumscribe a perimeter of said label panel area and extend in a longitudinal direction from the upper portion to the lower portion.

19. A label panel area of a plastic container adapted for vacuum absorption, the container having an upper portion including a mouth defining an opening into the container and a shoulder region, a lower portion forming a base, and the label panel area connected with and extending between said upper portion and said lower portion; the upper portion, the lower portion and the label panel area cooperating to define a receptacle chamber within the container into which product can be filled; said label panel area comprising sidewall portions that are generally parallel to a longitudinal axis of the container; a series of horizontal ribs formed in said sidewall portions; and a rigid grip area formed in said sidewall portions, wherein said rigid grip area comprises a first pair of indents, a second pair of indents and lands defined between each of said first pair of indents and each of said second pair of indents; said first pair of indents including a first arcuate ridge, vertical ridges, a second arcuate ridge and a grip surface; said second pair of indents being generally oval in shape.

20. The label panel area of claim 19 wherein said series of horizontal ribs are separated by lands, uninterruptedly circumscribe a perimeter of said label panel area and extend in a longitudinal direction from the upper portion to the lower portion.

* * * * *

UNITED STATES PATENT AND TRADEMARK OFFICE

CERTIFICATE OF CORRECTION

PATENT NO. : 7,455,189 B2
APPLICATION NO. : 11/208896
DATED : November 25, 2008
INVENTOR(S) : Michael T. Lane et al.

It is certified that error appears in the above-identified patent and that said Letters Patent is hereby corrected as shown below:

| | |
|---|---|
| Column 1, line 26 | "configureation" should be --configuration--. |
| Column 1, lines 61-62 | "manufactures" should be --manufacturers--. |

Signed and Sealed this

Tenth Day of March, 2009

JOHN DOLL
*Acting Director of the United States Patent and Trademark Office*